United States Patent [19]

Birch et al.

[11] 4,133,371

[45] Jan. 9, 1979

[54] CASTING

[75] Inventors: Ivan J. Birch; David Mills, both of Bristol, England

[73] Assignee: Rolls-Royce Limited, London, England

[21] Appl. No.: 826,545

[22] Filed: Aug. 22, 1977

[30] Foreign Application Priority Data

Aug. 31, 1976 [GB] United Kingdom ..... 36031/76

[51] Int. Cl.[2] ..... B22C 9/08

[52] U.S. Cl. ..... 164/350; 249/109; 249/79; 249/110; 249/160; 249/119; 249/163; 249/129; 249/121; 164/41; 164/363; 164/364

[58] Field of Search ..... 164/350; 249/110, 119, 249/129, 121, 109

[56] References Cited

U.S. PATENT DOCUMENTS

| | | | |
|---|---|---|---|
| 70,710 | 11/1867 | Fry | 249/110 X |
| 738,279 | 9/1903 | Beckwith | 249/110 X |
| 1,414,394 | 5/1922 | Batty | 249/110 |
| 2,502,595 | 4/1950 | Schermuly et al. | 249/119 |
| 3,104,665 | 9/1963 | Towns | 249/121 X |
| 3,116,523 | 1/1964 | Barber | 164/350 X |
| 3,598,175 | 8/1971 | Olsson et al. | 249/110 X |
| 3,810,506 | 5/1974 | Kobayashi | 249/110 X |
| 4,072,180 | 2/1978 | Hoult | 164/350 X |

*Primary Examiner*—J. Howard Flint, Jr.
*Attorney, Agent, or Firm*—Stevens, Davis, Miller & Mosher

[57] ABSTRACT

A mould assembly for producing multiple castings in which a plurality of mould components are closely arranged together in an array and define a plurality of mould cavities. At the base of the array there is provided a regularly shaped space which communicates with each of the individual mould cavities via a runner passage and thus molten metal admitted to the space fills each of the mould cavities simultaneously leading to uniform properties in all the castings. The individual mould components are preferably injected moulded in a ceramic material.

14 Claims, 17 Drawing Figures

CASTING

Figure 1:
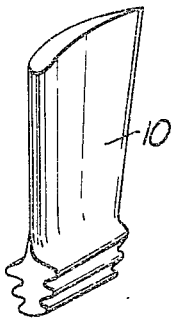

This invention relates to improvements in casting and has particular reference to a casting mould assembly for producing multiple castings simultaneously.

The production of multiple castings by investment or lost wax process is well established in the art and has proved capable of yielding high quality castings. In the production of multiple castings was replicas of each individual casting are produced and subsequently joined to the branches of a wax tree. The wax tree is then coated by dipping and stuccoing to form a mould around the outside of the wax. From this mould the wax is subsequently removed, by heating, in order to allow the molten metal to be poured into the spaces previously occupied by the wax. The various branches of the wax tree are arranged to act as risers and runners for the individual moulds.

Whilst this technique has been used for a good many years with great success it, nevertheless, can give rise to certain problems in use. The technique requires many different operations to be successively carried out and at each stage there is the possibility of causing some defect which will disadvantageously affect the finished product. Such defects include distortion or shrinkage of the waxes, imperfect formation of the shell mould during the dipping and stuccoing processes, fracture of the shell mould due to handling, particles of the shell mould breaking away and falling into the mould during dewaxing and fracture of the mould during casting giving rise to inclusions in the finished casting. In addition, it is very difficult to insulate the mould correctly in order to produce the desired crystal structure in the finished product. Insulation is especially required if the vacuum casting process is used. Having cast the mould it is also necessary to separate the finished articles from the riser and runner system which, because of the shape and layout of the mould, is a very hazardous business and in practice has required a skilled operator to handle the mould and manoeuvre it relative to an abrasive cutting disc. The assembly of the individual waxes to the branches of the wax tree is also an area which can give rise to severe problems. The waxes tend to be relatively brittle but to deform under the temperature of the human hand during handling, thus the twin dangers of breakage and deformation of the mould are always present. Having produced the shell mould it is customary, in some foundries, to place the mould in a box made from a costly heat resisting alloy and to pack the space around the mould with a refractory material on a vibrating table. The process is in this respect labour intensive and time and space consuming.

In an alternative process a ceramic compound is injected into an especially shaped die to produce moulds for producing multiple castings in which individual mould cavities corresponding to the individual castings are interconnected by a system of runners and risers. The tooling necessary to produce such a multiple mould is invariably relatively complex and costly and the fixed positional relationships of the various castings, which relationship is controlled by the need to keep the tooling as simple as possible, is frequently incompatible with the optimum arrangement of individual castings from a quality view point.

In one known method individual moulds are separately produced and subsequently joined together in rows by a ceramic adhesive. The individual moulds are each provided with through passages which are aligned on joining together of the individual moulds and to which the individual mould cavities are connected by various runner passages so that on casting of the mould by admission of melt to the through passages, the various individual moulds are sequentially filled and on removal of the mould a tree, or gang, of castings similar to that produced by the lost wax process is achieved.

As with the lost wax process difficulites exist in the separation of the castings from the tree and both of the processes suffer the considerable disadvantage that the individual mould cavities are filled sequentially and often in an unpredictable order. This has the generally undesirable result that the properties and metallographic structure of the individual castings differ because the conditions under which they solidfy vary on account of the variation of heat lost from the melt to the individual mould cavities.

The present invention seeks to provide a mould for producing multiple castings which at least partially overcomes the disadvantages of the previous methods, which enables the production of high quality castings at a relatively low cost, which enables the metal to be admitted to the individual mould cavities from below, and which allows the solidification of the cast metal to be controlled at will.

According to the present invention there is provided a mould assembly for producing multiple castings comprising a plurality of individual mould components disposed together in an array and defining a plurality of individual mould cavities, each individual mould component having a shape closely fitting the next adjacent individual mould components of the array at least at the outside side surfaces of the array there being in respect of each mould cavity a runner passage communicating with a space defined within the mould assembly adjacent the base of the array, means capable of admitting molten metal to the said space for subsequent filling of the individual mould cavities and means for sealing at least the exterior sides and base of the assembly against the leakage of molten metal therethrough. The array of individual mould components is preferably disposed on a base and separated therefrom by feet formed on the individual mould components to define the said space.

Each of the individual mould cavities can be defined by one or more of the individual mould components of the array.

Preferably the individual mould components are produced by transfer moulding of one of the known ceramic materials. In a preferred embodiment the individual mould components are formed as sectors of a cylinder and each of the individual mould cavities is formed within one of the sectors, the sectors are then stood on a base and the assembly is covered with a cover, and the outside sealed with a ceramic sealant. Molten metal is admitted to the space beneath the sectors via a central passage defined by the radially inward ends of the sector and rises via the runner passages, to fill the individual mould cavities simultaneously.

A further space can be provided between the cover and the array so that molten metal rising from the individual mould cavities fills also this further space and thus the finished castings are located between two spaced apart billets of metal. This allows the two billets to be clamped for mechanised cutting of the mould and runners to separate the as cast articles from the casting mould.

In a modification the individual mould components are provided with locating features which co-operate with locating features provided on the base or the cover to improve the positioning of the individual moulds.

In a further modification the sides of the individual mould components of the array are provided with cavities or pockets into which strips of insulating material, or insulation in other forms may be placed for selectively insulating the mould to assist in controlling the rates of cooling of different parts of the mould or, alternatively, molten metal may be admitted to the pockets to achieve a similar effect. As an alternative or complementary technique to the insulation described above, the thickness of the walls of the individual moulds can be varied so as to achieve the desired thermal gradient within the as poured casting during solidification thereof.

Figure 2:
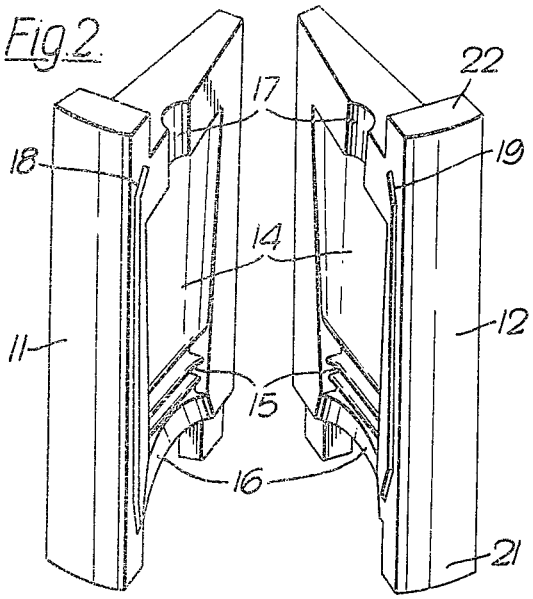
Figure 3:
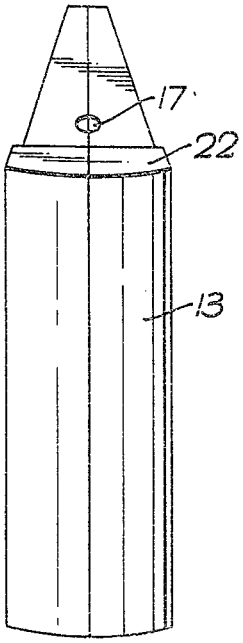
Figure 4:
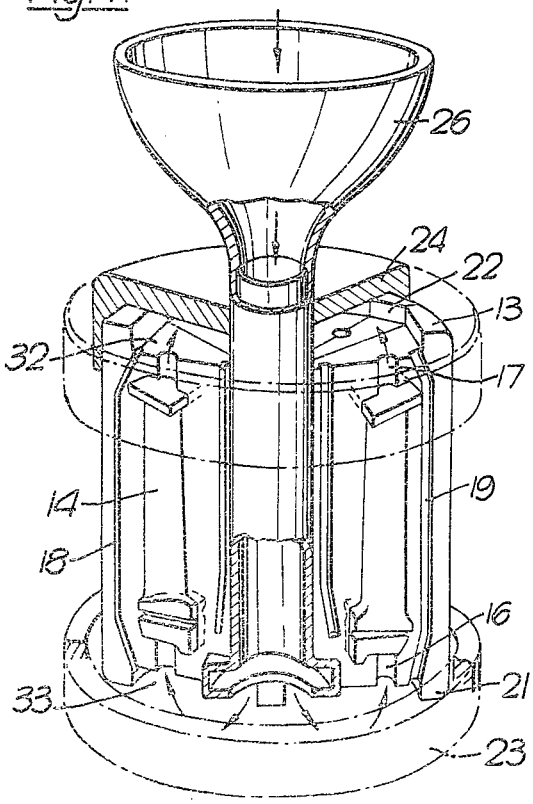
Figure 5:
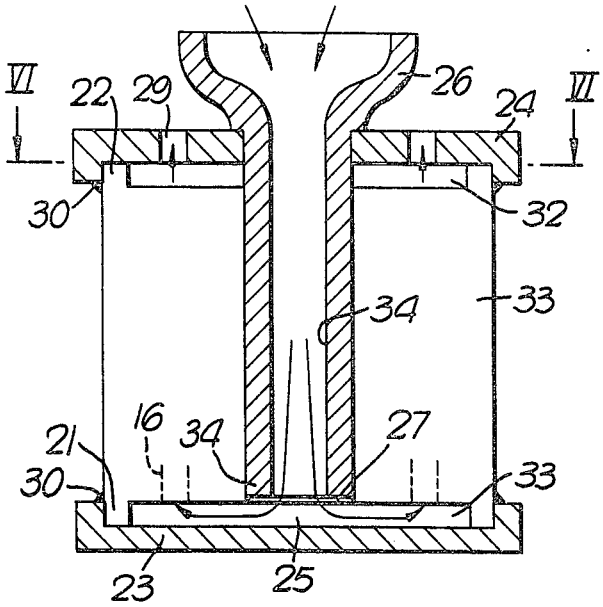
Figure 6:
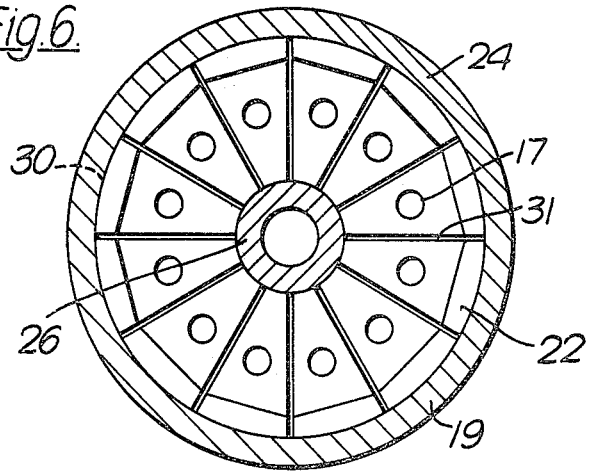
Figure 7:
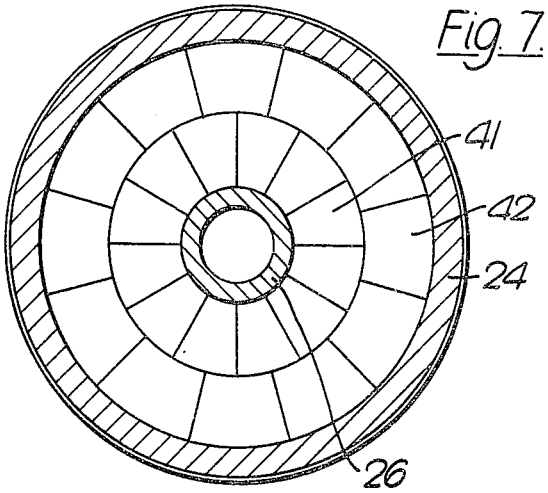
Figure 8:
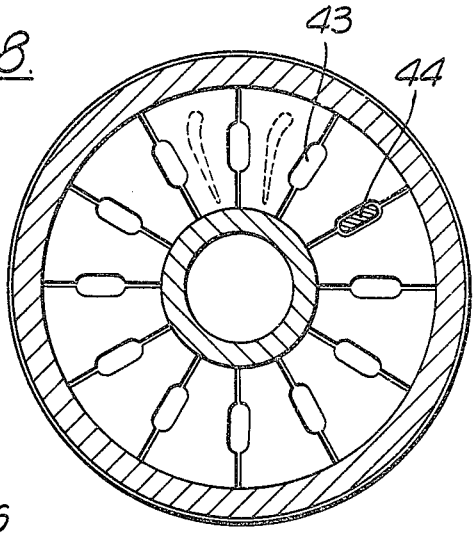
Figure 9:
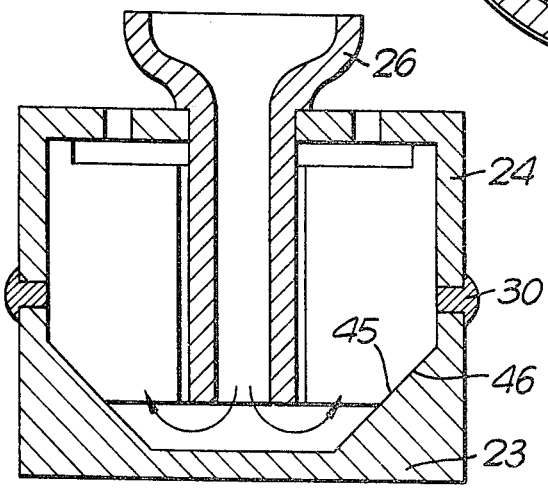
Figure 10:
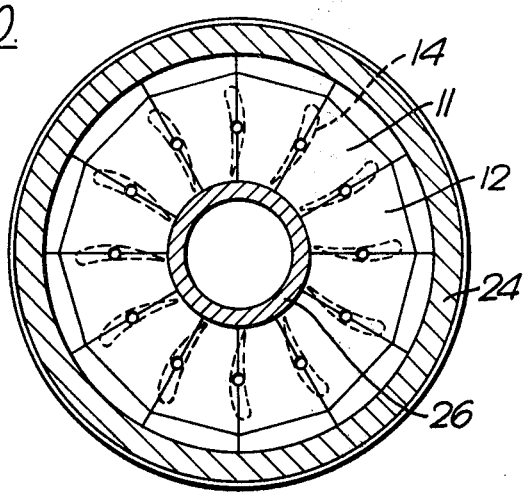
Figure 11:
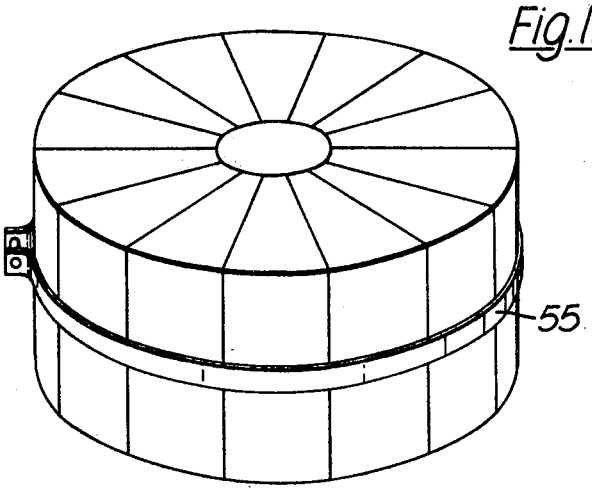
Figure 12:
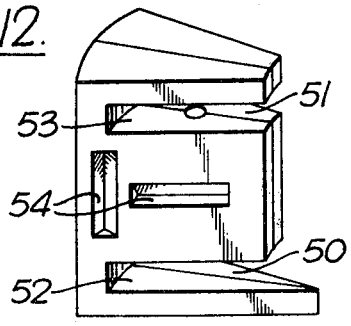
Figure 13:
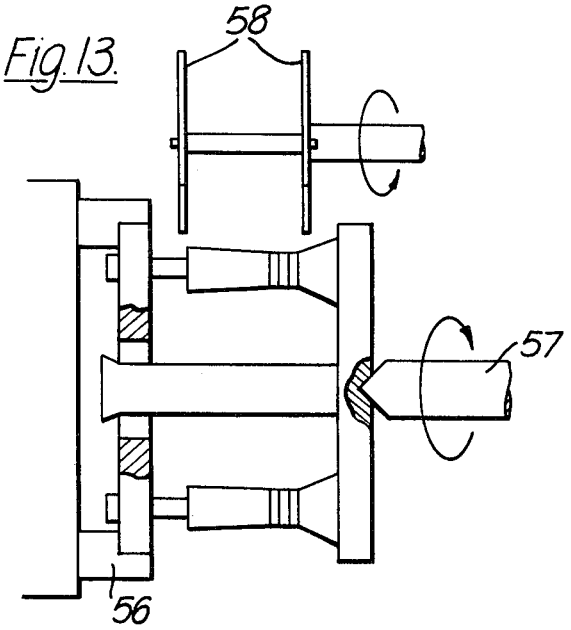
Figure 14:
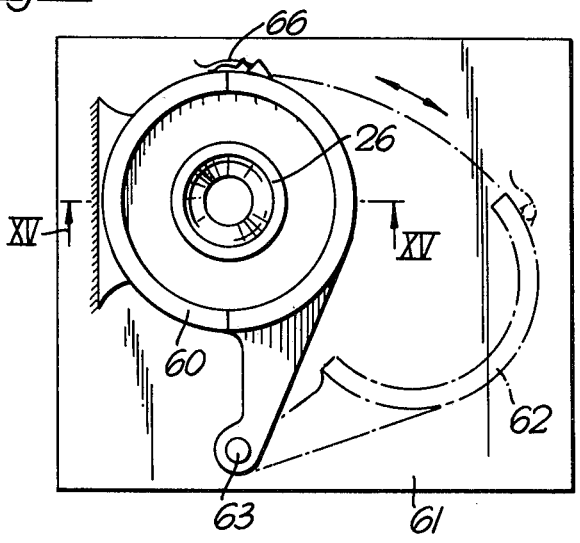
Figure 15:
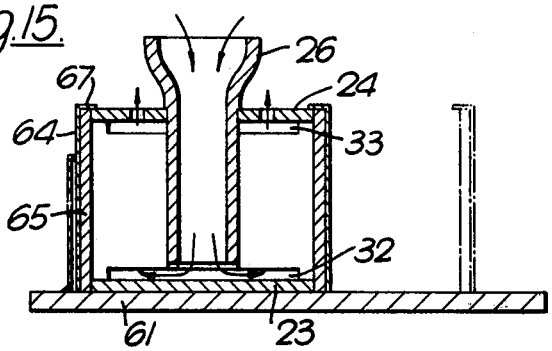
Figure 16:
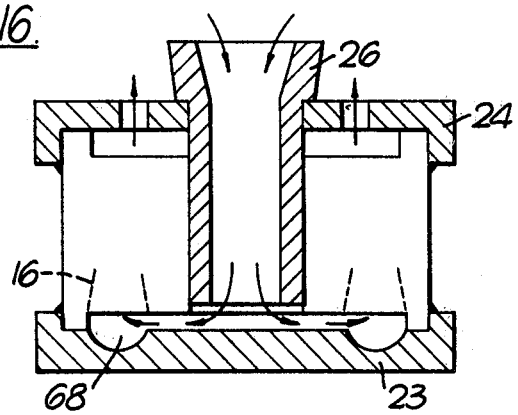
Figure 17:
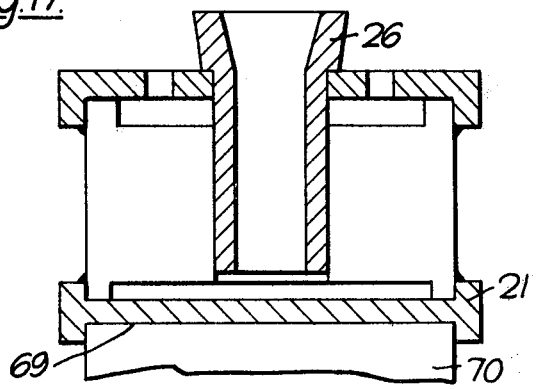

Embodiments of the invention will now be described by way of example only and with reference to the accompanying drawings in which:

FIG. 1 is a view of a blade for a gas turbine engine,

FIG. 2 is a view showing a two part ceramic mould suitable for producing the blade of FIG. 1, FIG. 3 shows the two parts of the mould of FIG. 2 assembled together to form an individual mould, FIG. 4 is a schematic view of a mould for producing multiple castings, FIG. 5 is a longitudinal section through the mould of FIG. 4, FIG. 6 is a view on the line VI—VI of FIG. 5 showing the disposition of the individual moulds in the mould, FIG. 7 is a view similar to view VI—VI of FIG. 5 showing an alternative disposition of individual moulds, FIG. 8 is a further view similar to the view VI—VI of FIG. 5 but showing the insulation of the individual moulds, FIG. 9 is a longitudinal section through an alternative mould construction, FIG. 10 is a further alternative mould construction, FIG. 11 illustrates a further alternative mould construction, FIG. 12 illustrates a detail of FIG. 11, FIG. 13 illustrates the mechanised removal of a riser and runner passage, FIG. 14 is a plan view of a mould illustrating an alternative method of sealing the mould, FIG. 15 is a section on the line XIV—XIV of FIG. 14 and, FIGS. 16 and 17 illustrate modifications of a casting mould, In FIG. 1 there will be seen a rotor blade 10 for a gas turbine engine which is a component required in large numbers and which is conveniently produced in a mould for multiple castings, Referring now also to FIGS. 2 and 3 there will be seen a two part ceramic mould, each individual mould component 11 and 12 of which is formed by the transfer moulding technique. The individual mould components have cavities 14 and 15 therein, suitable for producing the aerofoil and root portions of the blade and further pockets 16 and 17 which, in the finished individual blade mould 13 of FIG. 3 define the runner and riser passages for the individual mould 13. The two halves of the mould are provided with location features 18,19 and are joined together typically by glueing with ceramic adhesive. As an alternative method to the use of ceramic adhesive the mould halves are joined together by a conventional adhesive which has a low ash content when heated to a high temperature and the exterior split line of the individual mould between the individual mould components is sealed by coating it with a refractory cement or by clamping the individual mould components together mechanically. Suitable conventional adhesives for this purpose include waxes or hot or cold setting resins. As the individual mould components are produced by the pressure injection of ceramic into a die their dimensions, both internally and externally are accurately controlled, and thus the exterior profile of the finished individual mould of FIG. 3 is also accurately formed. While this is the preferred process it is, however, quite possible to produce the individual moulds by alternative processes well known from existing investment casting techniques and including slurry forming and powder pressing methods. There is, however, no restriction to these techniques and it is contemplated that the individual moulds could be formed by many other conventional foundry mould making processes such as resin bonding of sand moulds or the injection into a die of clay bonded by phenol formaldehyde. Although the surface finish and the temperature stability of such moulds is inferior to that of the preferred ceramic moulds it is nevertheless possible that, for less critical applications than the manufacture of turbine rotor blades, such other mould materials would prove useful. One ceramic material useful for the transfer moulding process comprises a mixture of, by weight, 110 parts of silicone resin, 400 parts of 100 mesh (British Standard) silica, six parts of aluminium stearate and three parts of aluminium acetate. This mixture is prepared prior to moulding by mixing it together at a temperature of about 65° C. The important characteristic of the process chosen for making the individual moulds is that it ultimately produces regular shaped individual moulds similar to that shown in FIG. 3. The individual moulds 13 are provided with raised features, in this case with feet 21 and pedestals 22 at opposite ends of the mould, and their purpose will be explained later. Turning now to FIG. 4 there will be seen a schematic view of a circular array of individual moulds 13. The array is shown partly broken away along the split lines of two of the individual moulds for the purposes of illustration. It will be noted that the array of individual moulds are placed with their one ends resting on a circular base 23 and that their top ends are covered by a correspondingly sized circular cover 24. As can be seen in more detail by referring also to FIGS. 5 and 6, the circular cover 24 has a central aperture 25 for receiving a pouring funnel or cup 26 whose narrow end finishes adjacent a central position 27 on the base 23. The individual moulds 13 are conveniently formed as segments of a hollow cylinder so that the circular aperture 28 formed by their radially inner ends assists in location of the pouring cup 24. The feet 21 serve to separate the individual moulds from base 23 thereby defining a space which enables molten metal admitted to the mould via the pouring cup 26 to flow into the moulds via the runner passages 16. In similar fashion the pedestals 22 space the cover 24 from the individual moulds so as to allow molten metal flowing through the riser passages 17 to reach the top of the mould and to escape through further apertures 29 formed in the cover. The mould is sealed to prevent loss of molten metal by using a ceramic sealing cement 30 to seal between the edges of the cover and the base and along the outside edges of the narrow interstices 31, which can be more clearly seen from FIG. 6, between the individual moulds. A suitable ceramic sealing cement comprises a mixture of 34,200 ml hydrolysed ethyl silicate, 25,320 ml of isopropyl alcohol, 3,660 ml of water, 60 ml of bydrochloric acid together with 130 kgms of zirconium silicate with an addition of 5% pipe clay.

A feature of the individual mould components of the array is that they have a shape closely fitting the next adjacent individual mould components of the array at least at the outside surfaces of the array. Thus, in this example pairs of individual mould components are readily joined together to form individual moulds and only relatively narrow interstices exist between the individual moulds which has the positive benefit that the exterior surface of the mould will be relatively easy to seal because the leakage of molten metal through the narrow interstices is unlikely to be severe.

The size of the feet 21 and the pedestals 22 is chosen to control the volume of metal which can occupy the polygonal sectioned spaces 32,33 at the ends of the mould adjacent to the riser passages 16 and the runner passages 17 respectively. The volumes of metal are chosen so as to control the rate and direction of solidification of the blades. As the narrow end 34 of the pouring cup 24 finishes adjacent the base of the mould the molten metal will fill the moulds from the bottom, this is a particularly advantageous feature of the mould arrangement. Turning now also to FIG. 7 a modification can be seen in which two concentric arrays of individual moulds, 41,42 are produced on the same base. This arrangement allows standardised sizes of bases, covers and feeding funnels to be utilised to produce a varied range of castings. The rationalised use of bases, covers and feeding funnels in turn allows these to be produced by a mass production technique.

Turning now to FIG. 8 it can be seen that pockets 43 are provided in the sides of the individual moulds and that this allows insulation 44 to be placed between the individual moulds to control the rate of heat loss from the moulds and thus to permit better control of the solidification of the as poured mould. The insulation is in the form of strips of a blanket of ceramic fibre insulation but can also conveniently comprise insulators in particulate or fibrous form, or any other form of high temperature insulation. If so desired an exothermic material can also be introduced into the pockets provided. It is also contemplated that the pockets can simply fill with molten metal during pouring of the mould thus using the hot metal in the pockets to avoid large temperature gradients across the walls of the individual moulds.

In FIG. 9 an alternative mould construction is shown in which the individual moulds 13 are provided with locating features, the inclined faces 45, which co-operate with corresponding location features, the conical recess 46, on the base 23. This arrangement allows the individual moulds to sit on the base in such a way that the interstices between the individual moulds are reduced to a minimal size. In this embodiment the sealing cement 30 is applied directly between the side edges of the cover and base.

In the foregoing each individual mould is defined by two individual mould components fixed together to produce one mould cavity. It is, however, possible to produce a mould cavity in each side of an individual mould component, and this is illustrated in FIG. 10. In FIG. 10 the array of individual mould components are all disposed together on the base 23 and a mould cavity is produced between each individual mould component and its next adjacent individual mould component.

Turning now also to FIGS. 11 and 12 a further embodiment of the invention is shown in which the base 23 and cover 24 are dispensed with and the mould comprises simply an array of individual moulds fitted together in a similar fashion to the slices of a cake and each individual mould is provided with a recess 50 and 51 which co-operate with the similar recess in the other individual moulds to provide spaces 52,53 equivalent to the polygonal spaces referred to in the previous embodiments. Because in this case there is no base or cover to assist the location of the individual moulds this is conveniently achieved by providing locations on the exterior surfaces of the individual moulds which co-operate with the adjacent individual moulds to locate the entire assembly relative to itself. Each of these locating features 54 includes elements of geometry which generally speaking, prevent relative displacement of the individual moulds and which, furthermore, can be used to improve the sealing of the mould. To ensure the mould remains together during use a metal clamp 55 is used to secure the mould together. It is, however, possible to replace this metal clamp with other means for securing the mould parts together, for example, the mould parts may be placed together within an enclosure and sand introduced into the enclosure and packed against the exterior surface of the array. This arrangement will be particularly useful for embodiments in which the mould is not preheated prior to casting and which is used for the casting of low melting point alloys of aluminium or magnesium.

One particular advantage arising from the use of any of the moulds hitherto described, is that the polygonal billets of the as cast mould can readily be gripped in a chuck to allow the mechanised removed of the blades and the ceramic mould parts. This can be seen in FIG. 13 in which one polygonal billet is held in a chuck 56 and the other part is centralised on a centre 57. The chuck may be indexed to a range of positions in which two rotating disc cutters 58 spaced apart by the length of a blade are brought into play to cut through the runner and riser portions.

Referring now to FIGS. 14 and 15 there is illustrated a technique for sealing between the side edges of the cover and base which avoids the need for supplying a sealing cement to the outside of the mould. Basically the sealing is achieved by producing two half cylindrical shells one of which 60 is fixed to a base 61 and the other of which 62 is supported on a pivot 63. The two halves 60,62 of the shell each comprise a metal backing 64 lined with a half cylindrical liner 65 either of ceramic or of metal and in use the base 23 and cover 24 are slid into engagement with the fixed half of the shell and secured thereto by a clamp 66. The metal parts of the shell have lips 67 at their top edges which retain the cover against floatation effects on the mould during pouring. Base 61 conveniently includes provision (not shown) for accommodating a chill plate which assists in the control of the rate of solidification of the blades.

The solidification of the as poured mould is readily controlled by varying the thermal masses of various parts of the mould. This can be done by changing the relative sizes of the two polygonal spaces 32,33 as already mentioned or alternatively as shown in FIG. 16 local depressions 68 are formed in the base 21 adjacent the runner passage 16 of each individual mould. This has the further advantage of improving the flow of metal into the individual moulds.

Referring now to FIG. 17 a further modification is shown in which the base 21 is provided with a recess 69 in its underside for locating the base on a cooled copper block 70 to promote directional or controlled solidification of the mould.

In the case of controlled solidification the array of individual moulds will be poured within a vacuum enclosure (not shown) in which induction heating coils surround the entire mould and pouring cup, and which is provided with a facility for lowering the mould away from the induction heating coils to a position in which the base of the mould and copper block 70 is in a relatively cool environment and the pouring cup 26 remains within the induction heating coils. This arrangement produces the necessary thermal gradient within the components of the mould to ensure the solidification takes place in a controlled manner thus avoiding the occurrence of micro-porosity. To achieve directional solidification many of the well known methods of controlling the movement of the solidification front in the individual moulds can be applied and the base of each individual mould cavity can be provided with a suitably shaped passage for inducing the growth of single crystal material.

It will be further appreciated by those skilled in the art, that many of the standard procedures used with conventional foundry techniques can be applied to the new method of casting. It is readily possible to substitute one of the individual moulds for a mould of a similar external shape but which is internally shaped to produce a test piece which can subsequently be examined as a control of the quality of the castings.

It is, of course, possible to cast several difficult components in any one mould by providing individual moulds having common exterior dimensions but with particular internal configurations for the mould cavity.

Whilst the present embodiments have been described in relation to a circular mould there is no reason why other shapes of mould, for example, square should not equally be used and there is, of course, nothing to prevent several different sectors of differing angles being included in one assembly.

It will be further appreciated that pouring the mould so that it fills from the bottom up, can be achieved by admitting metal to the space at the bottom of the mould from underneath or from the side and not necessarily as herein illustrated via a pouring cup from above.

There is of course no restriction to the individual mould components of the array being joined together or merely placed together. Thus, if desired the entire array of individual mould components can be joined together or only selected individual mould components can be joined together as in the foregoing description or the individual mould components can be simply placed together.

We claim:

1. A mold assembly for producing multiple castings comprising a plurality of individual elements each defining a part of a mold cavity; means holding a plurality of said elements in an array with the complementary cavity parts in registry to define a plurality of mold cavities, the upper and lower surfaces of said elements defining with said means two spaces at opposite ends of the array, said elements defining a runner passage from each mold cavity to both of said spaces and a central passageway interconnecting said spaces.

2. A mold assembly for producing multiple castings comprising a plurality of individual wedge shaped elements each defining in a radial face at least a part of a mold cavity, a cover with a circular flange, a base with a circular flange, said circular flanges girding a plurality of said elements in a circular array with their complementary mold cavity parts in registry, said cover and said base defining with said array a space at each end thereof, a runner passage from each mold cavity to both of said spaces, said wedge shaped elements coacting to define a central passageway interconnecting said spaces, said cover having an aperture therein in registry with said passageway.

3. An assembly as claimed in claim 2 in which said cover is provided with apertures from which excess of molten metal in the space defined between said cover and said array may escape.

4. An assembly as claimed in claim 2 in which said elements have feet and pedestals at their radially outer portions at axially opposite ends which, in the array, define with the base and cover said spaces.

5. An assembly as claimed in claim 1 in which said elements define a space in addition to said part of a mold cavity, said space being so situated that when said elements are held in array pockets are provided for receiving a heat exchange medium.

6. An assembly as claimed in claim 2 in which at least some of said elements define a space in a radial face different from that where the part of a mold cavity is situated, said spaces in the array constituting pockets for a heat exchange medium.

7. An assembly as claimed in claim 6 further comprising an exothermic material in said pockets.

8. An assembly as claimed in claim 6 further comprising an insulating material in said pockets.

9. An assembly as claimed in claim 2 in which said spaces are of sufficient volume to control solidification of molten metal admitted to the assembly.

10. An assembly according to claim 1 in which the individual mold elements are transfer molded in a mixture comprising by weight:

110 parts of a silicone resin
400 parts of 100 mesh (British Standard) silica
6 parts of aluminum stearate and
3 parts of aluminum acetate, the mixture being prepared by mixing it together at an elevated temperature in the range 50°–85° C.

11. An assembly according to claim 2 further including means for sealing the mold comprising a layer of sealant applied to the exterior of the array, the sealant comprising a mixture of:

34,200 milliliters of hydrolyzed ethyl silicate
25,320 milliliters of isopropyl alcohol
3,660 milliliters of water
60 milliliters of hydrochloric acid and
130 kilograms of zirconium silicate containing an addition of five percent of pipe clay.

12. An assembly according to claim 1, in which said holding means comprises a mechanical clamp for securing together the individual mold components of the array.

13. An assembly according to claim 1 further comprising a tube passing through the upper space and said passageway and discharging into said lower space.

14. An assembly according to claim 2, further comprising a tube passing through said aperture in said cover, through said central passageway and into the lower of said spaces.

* * * * *